US005155340A

United States Patent [19]

Morita et al.

[11] Patent Number: 5,155,340

[45] Date of Patent: Oct. 13, 1992

[54] THIN HIGH TEMPERATURE HEATER

[75] Inventors: Noriko Morita; Susumu Hoshinouchi; Yoshihiko Kusakabe; Minoru Kobayashi, all of Amagasaki, Japan

[73] Assignee: Mitsubishi Denki Kabushiki Kaisha, Japan

[21] Appl. No.: 550,976

[22] Filed: Jul. 11, 1990

[30] Foreign Application Priority Data

Jul. 12, 1989 [JP] Japan ..... 1-181016
Jul. 18, 1989 [JP] Japan ..... 1-186858

[51] Int. Cl.[5] ..... H05B 3/16

[52] U.S. Cl. ..... 219/543; 338/308

[58] Field of Search ..... 219/216, 543; 338/306, 338/308, 309, 305, 307, ; 346/76 PH; 427/402, 103, 419.7; 428/627, 901; 313/346 R, 336

[56] References Cited

U.S. PATENT DOCUMENTS 3,748,522 7/1973 Geppert ..... 313/310
4,096,510 6/1978 Arai et al. ..... 357/28
4,296,309 10/1981 Shinmi et al. ..... 219/216
4,361,782 11/1982 Depp et al. ..... 313/409
4,663,640 5/1987 Ikeda ..... 346/140 R
4,709,243 11/1987 Kato et al. ..... 346/76 PH
4,758,814 7/1988 Howng et al. ..... 338/34
4,827,289 5/1989 Tsuji et al. ..... 219/216
4,849,605 7/1989 Nakamori et al. ..... 219/216
4,907,015 3/1990 Kaneko et al. ..... 219/216
4,920,071 4/1990 Thomas ..... 437/188
4,985,750 1/1991 Hoshino ..... 357/71

FOREIGN PATENT DOCUMENTS 1072169 2/1980 Canada ..... 313/183

OTHER PUBLICATIONS

Schmid et al, "Titanium Impurity . . . Cathodes", Applications of Surface Science, 21, (1985), pp. 37–49.

Piggin et al., "Integrated Electron . . . CRT's", IEEE Proceedings of the SID, vol. 27, No. 2, 1986, pp. 125–131.

*Primary Examiner*—Bruce A. Reynolds
*Assistant Examiner*—Michael D. Switzer
*Attorney, Agent, or Firm*—Leydog, Voit & Mayer

[57] ABSTRACT

A thin high temperature heater includes an adhesive layer of Ti disposed an insulating substrate and a resistor layer of a Ti compound disposed the adhesive layer.

18 Claims, 6 Drawing Sheets

THIN HIGH TEMPERATURE HEATER

FIELD OF THE INVENTION

The present invention relates to a small heater for heating to high temperature and a manufacturing method therefor and, more particularly, to a thin heater for heating to high temperature such as a heater for an electron gun, a hot cathode X-ray tube, a Braun tube and so on which is used at approximately 1000° C. and a manufacturing method therefor.

BACKGROUND OF THE INVENTION

A plane type heater has been conventionally manufactured using techniques for forming a thick film circuit such as screen printing as disclosed in, for example Japanese Patent Publication Gazette No. 55-24646. FIG. 3 is a sectional view showing a cathode of an electron tube using a conventional heater. In FIG. 3, reference numeral 10 designates a ceramic substrate, reference numeral 11 designates a heating element layer, reference numeral 12 designates an insulating layer, reference numeral 13 designates a cathode lead layer, reference numeral 14 designates a base metal layer and reference numeral 15 designates a cathode material layer.

Then, a manufacturing method therefor will be described in detail hereinafter.

First, a raw material for forming the ceramic substrate 10 is prepared and then the heating element layer 11 having a desired pattern is formed on a sheet by a printing technique such as an extrusion method by which a material is extruded between rollers or a casting method. The heating element layer 11 is formed on the ceramic substrate 10 by screen printing a paste in which baking assistant is added to a heater agent. Thereafter, it is baked at high temperature (1000~2000° C.) and then the plane type heater is completed.

In this method, since there is a high temperature treatment in the manufacturing steps, when the heater is used at this temperature or less, it is expected that the heater will be stable at high temperature for a long time, for example a change of resistance with lapse of time is small. However, the pattern precision obtained by the screen printing is low and also it is difficult to control the thickness of the heating element 11, with the result that power consumption is large and the variation of resistance among a plurality of heaters is large. Therefore, a method for forming a film by PVD (Physical Vapor Deposition) or CVD (Chemical Vapor Deposition) has been developed for forming a heater pattern with high precision.

FIG. 4 includes sectional views showing manufacturing steps for forming a conventional plane thin type heater by a thin film forming method. A resistor film for a heater 3 usually formed of metal such as tungsten is uniformly formed on a plane ceramic substrate as an insulating material a desired pattern is formed by etching, a lead wire (not shown) is connected thereto, and finally the plane type thin heater is completed.

However, when the plane type thin heater is manufactured by the above method, the adhesion between the resistor film 3 for the heater and the insulating material 1 is small. Therefore, in order to increase the adhesion between the resistor film 3 and the insulating material 1, an adhesive layer is used. Usually, a Ti film with a thickness of several tens to several hundreds of nanometers (nm) is formed as the adhesive layer and then the resistor layer is formed thereon to provide the thin high temperature heater. However, while the heater is used with a voltage applied thereto, that is, when a high temperature load of 1000° C. is applied, Ti is degraded, causing the heater to break down. FIG. 6 shows the SEM photograph of a heater in a breakdown state (where 20.0KV is an accelerating voltage of the scanning electron microscope, ×350 is a magnifying factor of 350, and a length of the line indicated corresponds to 100 microns). The reason for the breakdown is believed to be the transformation point of Ti from $\alpha$ to $\beta$ phase (referred to as a transformation point hereinafter) at 882° C. and this transformation point is repetitively passed through while the heater is used. In addition, the resistance of the thin film resistor changes while it is used. FIG. 5 shows a change of resistance value with lapse of time. The reason why the resistance is reduced in an early stage is that recrystallization occurs in the thin film and then the size of the crystal grains in the thin film increase. For example, when the resistor (heating element) comprises W (tungsten) without an adhesive layer and is used at 1000° C., since the temperature of 1000° C. corresponds to the recrystallization temperature of W, recrystallization occurs. The reason why the resistance increases with lapse of time is that an impurity is mixed into the film or the film is oxidized by the ambient in use. In addition, since the insulating substrate of an oxide group such as $Al_2O_3$ is available in its monocrystalline state and a surface thereof can be mirror-finished, its pattern precision thereof is better than sintered substrates such as SiC, and AlN. Therefore, $Al_2O_3$ has been conventionally used as the insulating substrate (insulating material) of the conventional thin film high temperature heater manufactured by the thin film forming method. However, in the conventional heater using $Al_2O_3$, when the heating element is directly formed on the insulating material, the insulating material reacts with the heating element by thermochemical or electrochemical action caused by oxygen. Therefore, a substance which is likely to sublime is formed. As a result, an edge at which the $Al_2O_3$ substrate and the heating element such as W are both in contact with ambient in the vicinity of resistance wiring end (heating element end) is selectively damaged. FIGS. 7 and 8 are scanning electron microscope photographs showing two ends of a damaged heater. Thus, the conventional thin high temperature heater formed by the thin film forming methods is unstable as a heater and also unreliable as far as a long term use is concerned.

SUMMARY OF THE INVENTION

The present invention was made in order to solve the above problems and it is an object of the present invention to provide thin high temperature heater with a high reliability in which adhesion between a resistor film for a heater and an insulating material is high and a resistance change is small.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to an aspect of the present invention, a thin high temperature heater comprises an adhesive layer comprising Ti formed on an insulating material and a resistor layer comprising a Ti compound formed on the adhesive layer.

Accordingly, the Ti film increases adhesion between the insulating material and the resistor layer and the resistor layer is stable at high temperature as compared with a heater formed of metal because a Ti compound such as TiC, TiN or TiCN or a mixture thereof for the resistor layer is ceramic. Furthermore, even if Ti diffuses into the resistor layer while the heater is used, no deterioration occurs and the adhesive layer is stable because the resistor layer also comprises Ti.

According to another aspect of the present invention, an adhesive relaxation layer (resistor layer) comprising a TiC, TiN or TiCN or a mixture thereof and having a superior stability at high temperature is provided between the adhesive layer and the heating element. Therefore, adhesion between the heating element and the insulating material is high and Ti of the adhesive layer does not diffuse into the heating element. Furthermore, the heating element and the insulating material are not damaged by the interaction therebetween.

A method for manufacturing the thin high temperature heater in accordance with the present invention comprise the step of forming an adhesive layer comprising Ti on an insulating substrate and a resistor layer comprising a Ti compound at temperature below the transformation point of $\alpha$ to $\beta$ phase of Ti or forming them at temperature of the transformation point or higher.

Since the adhesive layer and the resistor layer are formed a temperature below the transformation point or at temperature of the transformation point or higher, Ti is not degraded by high temperature while the heater is manufactured. More specifically, when they are formed at temperature below the transformation point, Ti is not transformed from $\alpha$ to $\beta$ phase while the heater is manufactured, with the result that degradation is not likely to occur because of a change of volume. When they are formed at the temperature of the transformation point or higher, since Ti from the adhesive layer diffuses while the heater is manufactured, even if it is used thereafter at the temperature of the transformation point or higher, degradation by high temperature caused by the $\alpha$ to $\beta$ transformation of Ti does not occur.

DETAILED DESCRIPTION OF THE PREFERRED EMBODIMENT

An embodiment of the present invention will be described in detail with reference to the drawings.

Figure 1:
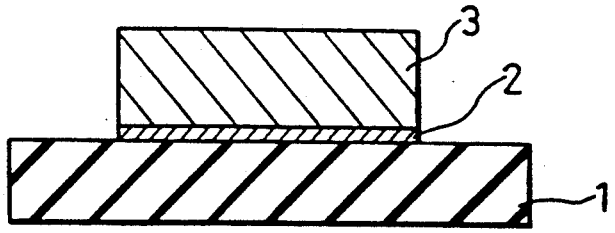
FIG. 1 is a sectional view showing a thin high temperature heater in accordance with an embodiment of the present invention.

FIG. 1 is a sectional view showing a thin high temperature heater in accordance with an embodiment of the present invention. In FIG. 1, reference numeral 1 designates an insulating material, reference numeral 2 designates a Ti layer serving as an adhesive layer to the insulating material 1, and reference numeral 3 designates a resistor layer comprising a Ti compound of TiC, TiN or TiCN or a mixture of them and formed on the adhesive layer 2. Here, it is desirable that the insulating material have good heat conductivity a thermal expansion coefficient close to that of the resistor layer 3 be a good insulator, not break down at high temperature, and is planar. Therefore, in view of availability, it may be AlN, $Al_2O_3$ or the like.

In addition, as for a material of the adhesive layer 2, it is not particularly limited if it increases adhesion between the resistor layer 3 and the insulating material 1. For example, a metal such as Ti, V, Cr, Y, La, Zr, Nb or Hf which has a thickness of 10 nm or less may be used and particularly Ti having the above thickness is most preferable among them because it is highly adhesive between the heating element 4 and the insulating material 1. In addition, when the thickness of Ti exceeds 10 nm, degradation by high temperature occurs after repetitive use above the transformation point of Ti, which could cause a heater to break down.

The reason why the resistor layer 3 is formed of a Ti compound such as TiC, TiN or TiCN or a mixture of them is that it has high recrystallization temperature and it has high electrical stability at high temperature. For example, a general heater material such as W or Mo may be used. However, such general heater materials take oxygen (deoxidizes) from the substrate 1 and form an oxide having high vapor pressure and scatter when this is formed on, for example, an $Al_2O_3$ substrate 1 and used at a temperature of approximately 1000° C. More specifically, the resistor layer is etched away so that its configuration deforms. Therefore, it is stable while used as a heater, if the ambient or temperature is limited.

Two methods for manufacturing a thin high temperature heater using a monocrystalline sapphire substrate ($Al_2O_3$) as the insulating material 1 will be described hereinafter.

Figure 2:
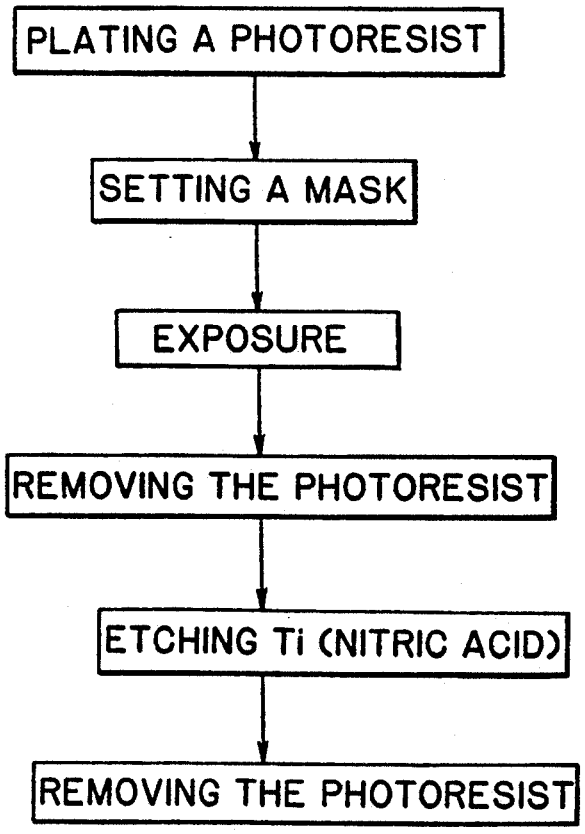
FIG. 2 illustrates a general etching process which is a part of manufacturing process for the thin high temperature heater shown in FIG. 1.
Figure 3:
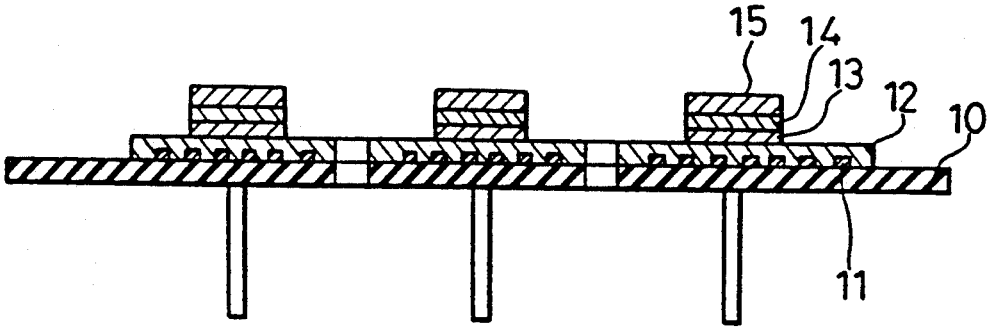
FIG. 3. (PRIOR ART)
FIG. 3 is a sectional view showing a cathode of an electron tube using a conventional thin high temperature heater.
Figure 4:
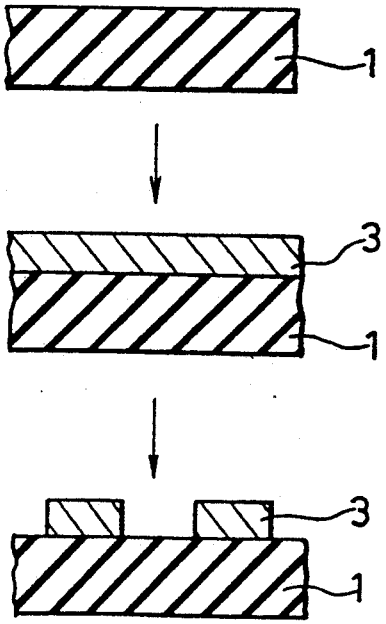
FIG. 4. (PRIOR ART)
FIG. 4 are views showing manufacturing steps for the conventional thin high temperature heater
Figure 5:
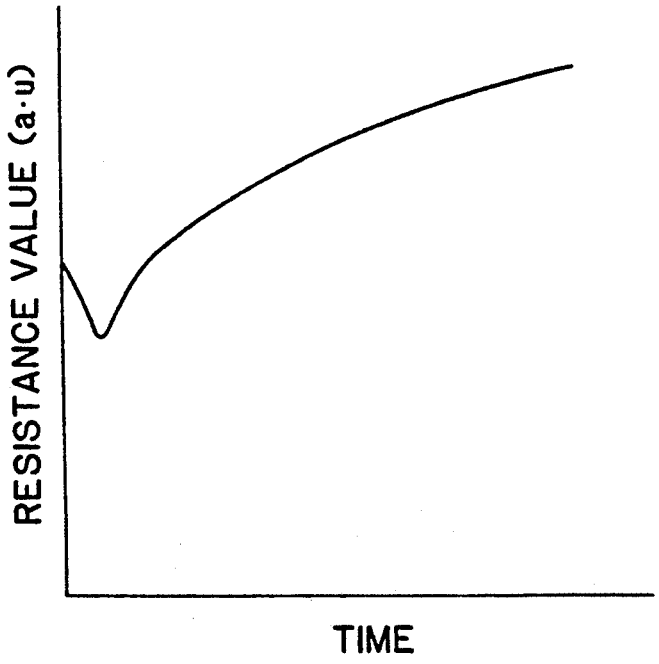
FIG. 5. (PRIOR ART)
FIG. 5 is a graph showing a change of resistance value in the conventional thin film with lapse of time.
Figure 6:
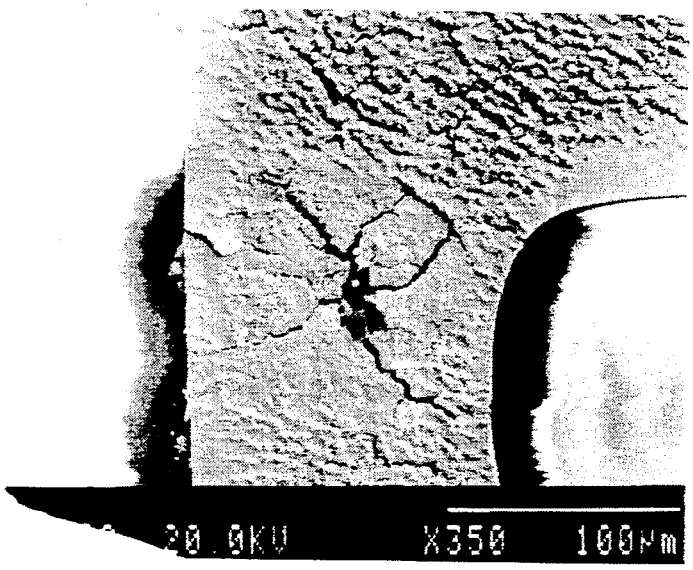
FIG. 6 is a scanning electron microscope photograph showing a heating element of a conventional thin high temperature heater, which is degraded by Ti at high temperature.
Figure 7:
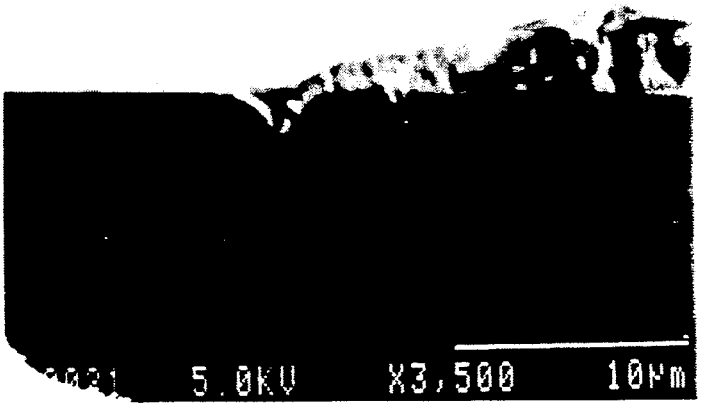
FIGS. 7 and 8 are scanning electron microscope photograph showing two ends of a damaged heater in the plane type thin heater using a conventional oxide insulating substrate.
Figure 8:
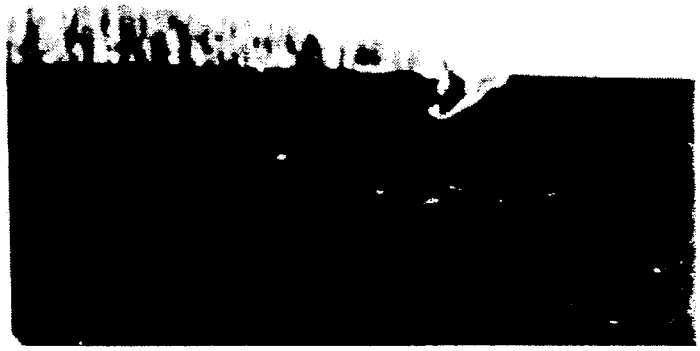

First, a first method will be described with reference to one example. A Ti film having a desired thickness (several microns to 10 microns) is uniformly formed on the $Al_2O_3$ substrate at 200~300° C. by sputtering. Then, it is etched to leave a desired pattern configuration by wet or dry etching. In case of wet etching, the etching is performed through the general steps as shown in FIG. 2. A sample having the pattern is arranged in a vacuum chamber for nitriding and then nitriding is performed below the temperature of transformation point of Ti, for example 400~500° C. and then N is diffused from the Ti surface. As a result, TiN is formed. Nitriding is performed to produce a layer which contributes to the adhesion between Ti and $Al_2O_3$ at an interface with the substrate (10 nm or less). The depth of TiN is approximately several microns to 10 microns. If the nitriding is performed using a DC power supply, the $Al_2O_3$ insulating material is not damaged and only the electrically conductive Ti is nitrided.

Although a method for forming the Ti film by sputtering is described in the above embodiment, that it may be formed by a PVD method such as an electron beam deposition method, a laser PVD method or an ion plating method. In addition, although the pattern of Ti is formed and then nitriding is performed in the above embodiment, the same effect can be obtained even if nitriding is performed after the Ti film is formed and then the film is etched away by hot nitric acid or the like.

Although nitriding is performed using $N_2$ gas in the above embodiment, TiC, TiN or TiCN or a mixture thereof may be formed by carbonization using a mixture of $CH_4$ and $N_2$.

As described above, according to the first method, the Ti film is formed and then nitriding or carbonization is performed at a surface before or after patterning.

A second method will be described in reference to one example. A pattern mask is put on the $Al_2O_3$ substrate heated to the desired temperature which is the transformation point of Ti or less, for example 200~300° C., and then a Ti film is formed by a normal Ar sputtering method. When an extremely thin film is formed before the thickness of the Ti film reaches 10nm, $N_2$ gas is introduced into the sputtering atmosphere and a TiN film having a desired thickness (several microns to 10 microns) is formed by reactive sputtering. Then, TiC, TiN or TiCN or a mixture thereof is formed by changing the introduced gas to a gas comprising carbon, for example a mixture of $CH_4$ and $N_2$.

As described above, according to the second method, different films are continuously formed, for example Ti and then TiN during the process for forming the film.

The thus manufactured thin type high temperature heater is not likely to be degraded by a change of volume because the adhesive layer and the resistor layer are both formed at a temperature which is below the transformation point of Ti and the transformation from $\alpha$ to $\beta$ phase of Ti does not occur while the heater is manufactured. In addition, even if extra Ti element for from the adhesive layer diffuses into the resistor layer while the heater is used, since the resistor layer comprises a Ti, the adhesive layer is stable.

In addition, when the size of a heater is increased or it is mass-produced, a plurality of thin high temperature heaters in accordance with the second method may be formed on the substrate.

Figure 9:
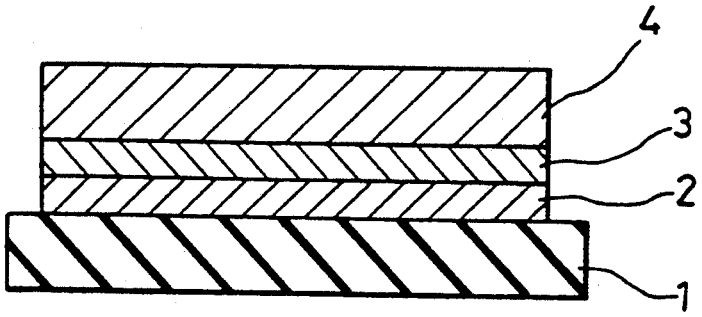
FIG. 9 is a sectional view showing a thin high temperature heater in accordance with another embodiment of the present invention.

In addition, a stable layer can be formed of a material which a low vapor pressure and stable electrical characteristic at a high temperature, such as W or Mo, on the insulator layer of the thin high temperature heater formed in accordance with the second method, as shown in FIG. 9, and then this can be used as the heating element. In this case, the resistor layer functions as an adhesive relaxation layer which prevents Ti of the adhesive layer from diffusing into the heating element.

Although the adhesive layer and the resistor layer (adhesive relaxation layer) are both formed at a temperature below the transformation point of Ti in the above embodiment, they may be both formed at the temperature of the transformation point of Ti or higher. In this case, since the Ti for the adhesive layer is diffused in the manufacturing process, even if it is used at the temperature of the transformation point or higher, for example 1000° C., high temperature degradation caused by the $\alpha$ to $\beta$ phase transformation of Ti does not occur.

As described above, according to an aspect of the present invention, a thin high temperature heater comprises an adhesive layer comprising Ti and formed on an insulating material and a resistor layer comprising a Ti compound and formed on the adhesive layer. As a result, it is possible to provide a thin high temperature heater with high reliability in which adhesion between the resistor layer and the insulating material is high and resistance is not likely to change while it is used.

According to another aspect of the present invention, an adhesive relaxation layer (resistor layer) comprising TiC, TiN or TiCN or a mixture thereof and having superior stability at a high temperature is disposed between the adhesive layer and the heating element: Therefore, adhesion between the heating element and the insulating material is high and Ti of the adhesive layer does not diffuse into the heating element. Furthermore, the heating element and the insulating material are not damaged by the interaction therebetween.

Furthermore, according to the present invention, when the adhesive layer comprising Ti and the resistor layer comprising the Ti compound are formed on the insulating substrate, those layers are both formed at a temperature below the transformation point of $\alpha$ to $\beta$ phase of Ti or both are formed at temperature of the transformation point or higher. As a result, Ti is prevented from being degraded by high temperature while the heater is manufactured.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thin high temperature heater comprising:

an electrically insulating substrate;

an adhesive layer selected from the group consisting of V, Cr, Y, La, Zr, Nb, and Hf disposed on said substrate; and a resistor layer selected from the group consisting of TiC, TiN, TiCN, and mixtures thereof disposed on said adhesive layer.

2. A method for manufacturing a thin high temperature heater comprising successively forming an adhesive layer selected from the group consisting of V, Cr, Y, La, Zr, Nb, and Hf and a resistor layer selected from the group consisting of TiC, TiN, TiCN, and mixtures thereof and disposed on the adhesive layer.

3. A method for manufacturing a thin high temperature heater comprising successively forming an adhesive layer selected from the group consisting of V, Cr, Y, La, Zr, Nb, and Hf and a resistor layer selected from the group consisting of TiC, TiN, TiCN, and mixtures thereof and disposed on the adhesive layer.

4. A thin high temperature heater in accordance with claim 1, wherein said adhesive layer is no more than 10 nm in thickness.

5. A method for manufacturing a thin high temperature heater in accordance with claim 2 including depositing said adhesive layer to a thickness of no more than 10 nm.

6. A method for manufacturing a thin high temperature heater in accordance with claim 3 including depositing said adhesive layer to a thickness of no more than 10 nm.

7. A thin high temperature heater comprising:
an electrically insulating substrate;
an adhesive layer selected from the group consisting of Ti, V, Cr, Y, La, Zr, Nb, and Hf disposed on said substrate;
an adhesive relaxation layer selected from the group consisting of TiC, TiN, TiCN, and mixtures thereof and disposed on said adhesive layer; and
a heating element comprising a metal disposed on said adhesive relaxation layer.

8. A method for manufacturing a thin high temperature heater comprising successively forming an adhesive layer selected from the group consisting of Ti, V, Cr, Y, La, Zr, Nb, and Hf and an adhesive relaxation layer selected from the group consisting of TiC, TiN, TiCN, and mixtures thereof and disposed on the adhesive layer at a temperature below the transformation temperature of the $\alpha$ to $\beta$ phase transformation of Ti.

9. A method for manufacturing a thin high temperature heater comprising successively forming an adhesive layer selected from the group consisting of Ti, V, Cr, Y, La, Zr, Nb, and Hf and an adhesive relaxation layer selected from the group consisting of TiC, TiN, TiCN, and mixtures thereof and disposed on the adhesive layer at a temperature at least equal to the transformation temperature of the $\alpha$ to $\beta$ phase transformation of Ti.

10. A thin high temperature heater in accordance with claim 7, wherein said adhesive layer is no more than 10 nm in thickness.

11. A method for manufacturing a thin high temperature heater in accordance with claim 8 including depositing said adhesive layer to a thickness of no more than 10 nm.

12. A method for manufacturing a thin high temperature heater in accordance with claim 9 including depositing said adhesive layer to a thickness of no more than 10 nm.

13. A thin high temperature heater comprising:
an electrically insulating substrate;
a Ti adhesive layer disposed on said substrate; and
a resistor layer selected from the group consisting of TiC, TiN, TiCN, and mixtures thereof disposed on said adhesive layer.

14. A method for manufacturing a thin high temperature heater comprising successively forming a Ti adhesive layer and a resistor layer selected from the group consisting of TiC, TiN, TiCN, and mixtures thereto and disposed on the adhesive layer at a temperature below the transformation temperature of the $\alpha$ to $\beta$ phase transformation of Ti.

15. A method for manufacturing a thin high temperature heater comprising successively forming a Ti adhesive layer and a resistor layer selected from the group consisting of TiC, TiN, TiCN, and mixtures thereof and disposed on the adhesive layer at a temperature at least equal to the transformation temperature of the $\alpha$ to $\beta 0$ phase transformation of Ti.

16. The thin high temperature heater of claim 7 wherein said substrate is selected from the group consisting of alumina 17. The method of claim 8 wherein said substrate is selected from the group consisting of alumina and aluminum nitrade.

18. The method of claim 9 wherein said substrate is selected from the group consisting of alumina and aluminum nitrade.

* * * * *